US007614809B2

(12) United States Patent
Kaiya

(10) Patent No.: US 7,614,809 B2
(45) Date of Patent: Nov. 10, 2009

(54) HEAD SUPPORT STRUCTURE, PRINTING DEVICE, THERMALLY ACTIVATING DEVICE, AND PRINTER

(75) Inventor: Mitsuhiro Kaiya, Chiba (JP)

(73) Assignee: Seiko Instruments Inc. (JP)

( * ) Notice: Subject to any disclaimer, the term of this patent is extended or adjusted under 35 U.S.C. 154(b) by 435 days.

(21) Appl. No.: 11/705,698

(22) Filed: Feb. 13, 2007

(65) Prior Publication Data

US 2007/0201928 A1 Aug. 30, 2007

(30) Foreign Application Priority Data

Feb. 23, 2006 (JP) ..... 2006-046879

(51) Int. Cl.
*B41J 2/32* (2006.01)

(52) U.S. Cl. ..... 400/120.16; 347/197

(58) Field of Classification Search ..... 400/120.16, 400/120.17; 347/197, 198
See application file for complete search history.

(56) References Cited

U.S. PATENT DOCUMENTS

RE35,026 E * 8/1995 Mahoney ..... 400/120.17
5,746,520 A * 5/1998 Kohira ..... 400/120.01
6,276,848 B1 8/2001 Takizawa et al. ..... 400/120.01
7,001,089 B2 * 2/2006 Tozaki et al. ..... 400/708
7,002,611 B2 * 2/2006 Mori et al. ..... 347/215
2004/0119808 A1 6/2004 Mori ..... 347/220

FOREIGN PATENT DOCUMENTS

EP 0764544 3/1997
EP 0806297 11/1997
EP 1547790 6/2005
JP 2004034305 A * 2/2004

* cited by examiner

*Primary Examiner*—Daniel J Colilla
(74) *Attorney, Agent, or Firm*—Adams & Wilks

(57) ABSTRACT

Provided is a head support structure including: a thermal head (11) for heating a sheet material (5); a platen roller (12) for transporting the sheet material (5) being pressed by the thermal head (11); a head support member (13) for supporting the thermal head (11), which is capable of moving in a direction in which the head support member (13) is brought into close contact with or moved away from the platen roller (12); and a head biasing member (14) for biasing the head support member (13) to a side of the platen roller (12). Further, the head biasing member (14) is formed of an elastic material and includes a pressing part (14*a*) for pressing the head support member (13) against the side of the platen roller (12) and holding parts (14*b*) provided at each end of the pressing part (14*a*), for holding the platen roller (12). Accordingly, a structure of the head support structure is simplified and an entire apparatus to which the head support structure is mounted can be downsized.

18 Claims, 14 Drawing Sheets

FIG. 14A PROIR ART
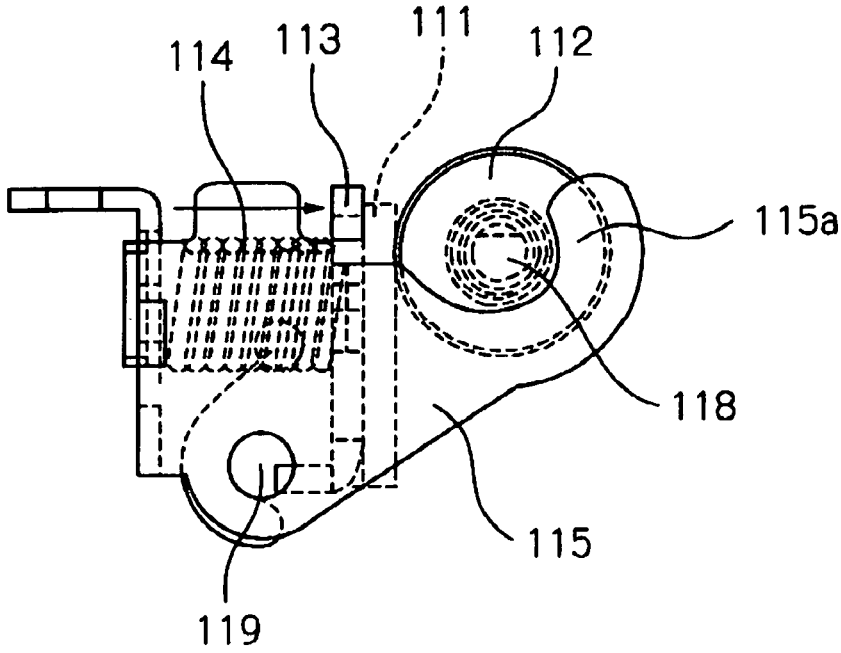
FIG. 14B PROIR ART
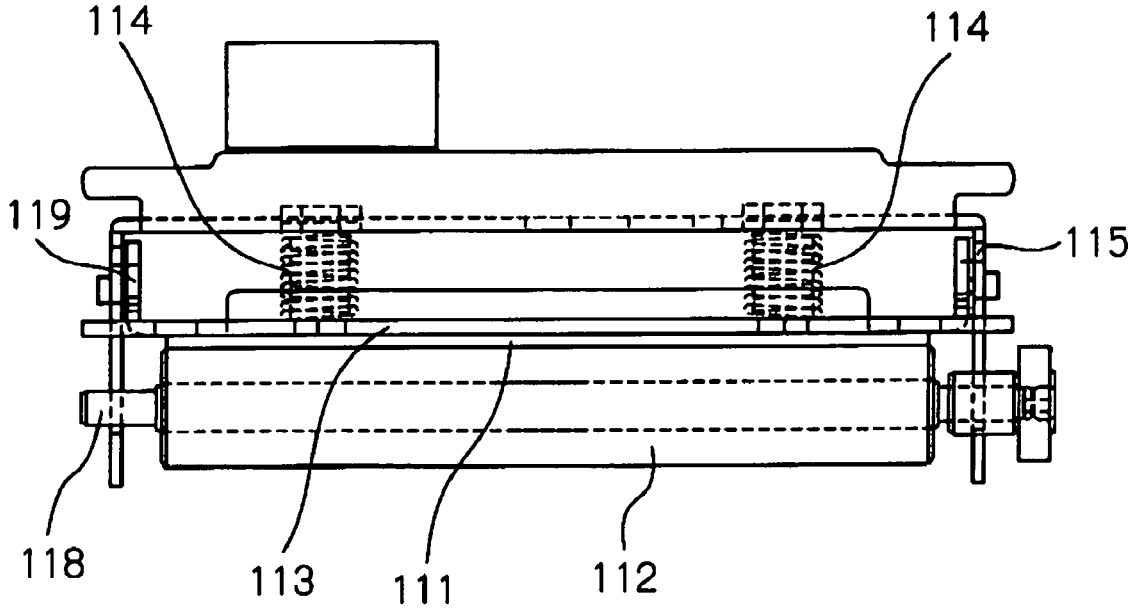

HEAD SUPPORT STRUCTURE, PRINTING DEVICE, THERMALLY ACTIVATING DEVICE, AND PRINTER

BACKGROUND OF THE INVENTION

1. Field of the Invention

The present invention relates to a head support structure in which a head is pressed against a sheet material transported by a platen roller when printing is performed on the sheet material, and also relates to a printing device, a thermally activating device, and a printer, which are equipped with the head support structure.

2. Description of the Related Art

Up to now, there is known a printer, which is called a thermal printer, for heating a sheet material to perform printing, for example. Such the thermal printer supports a thermal head for heating a heat-sensitive printing layer of the sheet material and includes a head support structure for pressing the thermal head against the sheet material.

As a conventional head support structure, as shown in FIGS. 14A and 14B, there is disclosed a structure including a thermal head 111, a head support member 113 for supporting the thermal head 111, a plurality of compressed coil springs 114 for biasing the head support member 113 to a platen roller 112 side, and a lock arm 115 for holding the platen roller 112 at a position where the platen roller 112 is pressed against thermal head 111 side (see, for example, JP 2003-200624 A).

In the conventional head support structure thus constructed, the head support member 113 and the lock arm 115 are rotated around a rotation shaft 119 and the head support member 113 is pressed by the compressed coil springs 114 each generating a biasing force, whereby the thermal head 111 is pressed against the platen roller 112 while nipping a sheet material therebetween. Further, a rotary shaft 118 of the platen roller 112 is engaged to a holding part 115*a* of the lock arm 115 when the thermal head 111 is pressed against the platen roller 112, whereby a state where the platen roller 112 is held is established.

The above-mentioned thermal printer is desired to be further downsized. However, the conventional head support structure includes a plurality of compressed coil springs for biasing a head support member which supports a thermal head to a platen roller side, and a lock arm for holding the platen roller at the position where the platen roller is pressed against the thermal head side.

Accordingly, as shown in FIGS. 14A and 14B, in the conventional head support structure, it is necessary to provide a portion in which the compressed coil springs 114 are arranged to elastically deform the head support member 113 in a direction in which the head support member 113 is pressed against the platen roller 112 side. As a result, a portion opposed to the head support member 113 which is opposite to the platen roller 112 side is occupied by the compressed coil springs 114. That is, since the lock arm 115 and the compressed coil springs 114 take up too much space in the conventional head support structure, it is difficult to downsize an entire apparatus to which the head support structure is mounted.

SUMMARY OF THE INVENTION

Therefore, an object of the present invention is to provide a head support structure including a head biasing member for pressing a heating head and holding a platen roller, which contributes to downsize an entire device to which the head support structure is mounted, and also to provide a printing device, a thermally activating device, and a printer, which are equipped with the head support structure.

In order to attain the above-mentioned object, a head support structure according to the present invention includes: a heating head for heating a sheet material; a platen roller for transporting the sheet material being pressed by the heating head; a head support member for supporting the heating head, which is capable of moving in a direction in which the head support member is brought into close contact with or moved away from the platen roller; and a head biasing member for biasing the head support member to a side of the platen roller. The head biasing member is formed of an elastic material and includes a pressing part for pressing the head support member against the side of the platen roller and holding parts provided at each end of the pressing part, for holding the platen roller.

In the head support structure according to the present invention thus constructed, the pressing part of the head biasing member presses the head support member against the platen roller side and the holding part of the head biasing member holds the platen roller. Accordingly, a number of the components is made small and an entire device to which the head support structure is mounted can be downsized.

Further, there is provided a printing device according to the present invention including the head support structure of the present invention, in which the heating head is a print head for heating a heat-sensitive printing layer of a sheet material to perform printing.

Further, there is provided a thermally activating device according to the present invention including the head support structure of the present invention, in which the heating head is a thermally activating head for thermally activating a heat-sensitive adhesive layer of a sheet material.

Further, a printer according to the present invention includes the thermally activating device of the present invention and a printing device for performing printing on a sheet material.

As described above, according to the present invention, the heating head can be biased to the platen roller side and the platen roller can be held in a state where the platen roller is pressed against the heating head side by the head biasing member alone, whereby the structure is simplified and an entire device to which the head support structure is mounted can be downsized.

BRIEF DESCRIPTION OF THE DRAWINGS

In the accompanying drawings:

FIGS. 14A and 14B are explanatory views each showing a conventional head support structure.

DETAILED DESCRIPTION OF THE PREFERRED EMBODIMENTS

Figure 1:
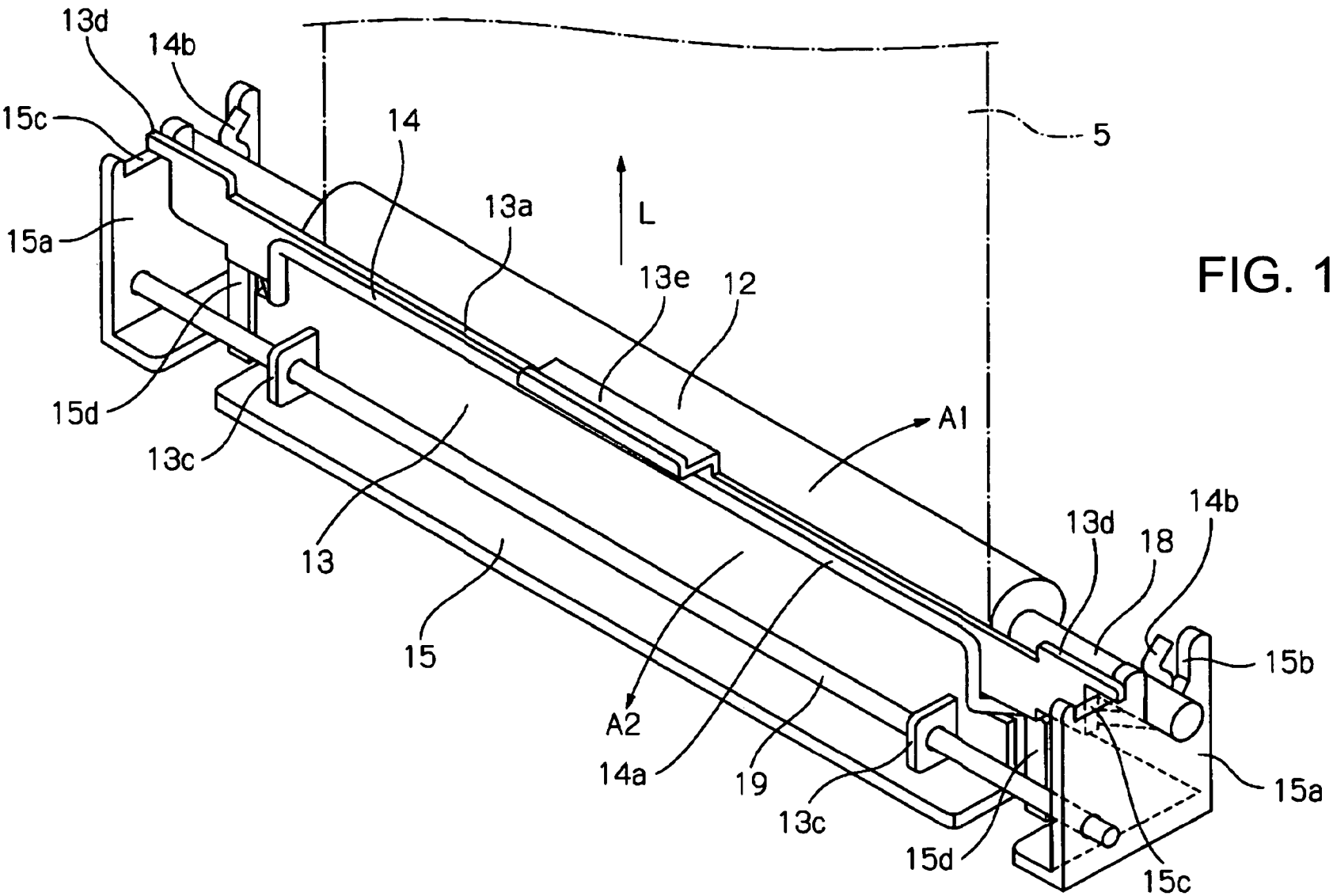
FIG. 1 is a perspective view showing a main part of a thermal printer according to a first embodiment of the present invention.

Hereinafter, specific embodiments of the present invention are explained referring to the drawings.

Used as a sheet material used for a thermal printer of each embodiment is a so-called heat-sensitive sheet provided with a heat-sensitive printing layer on a surface of a sheet-like base.

First Embodiment

Figure 2:
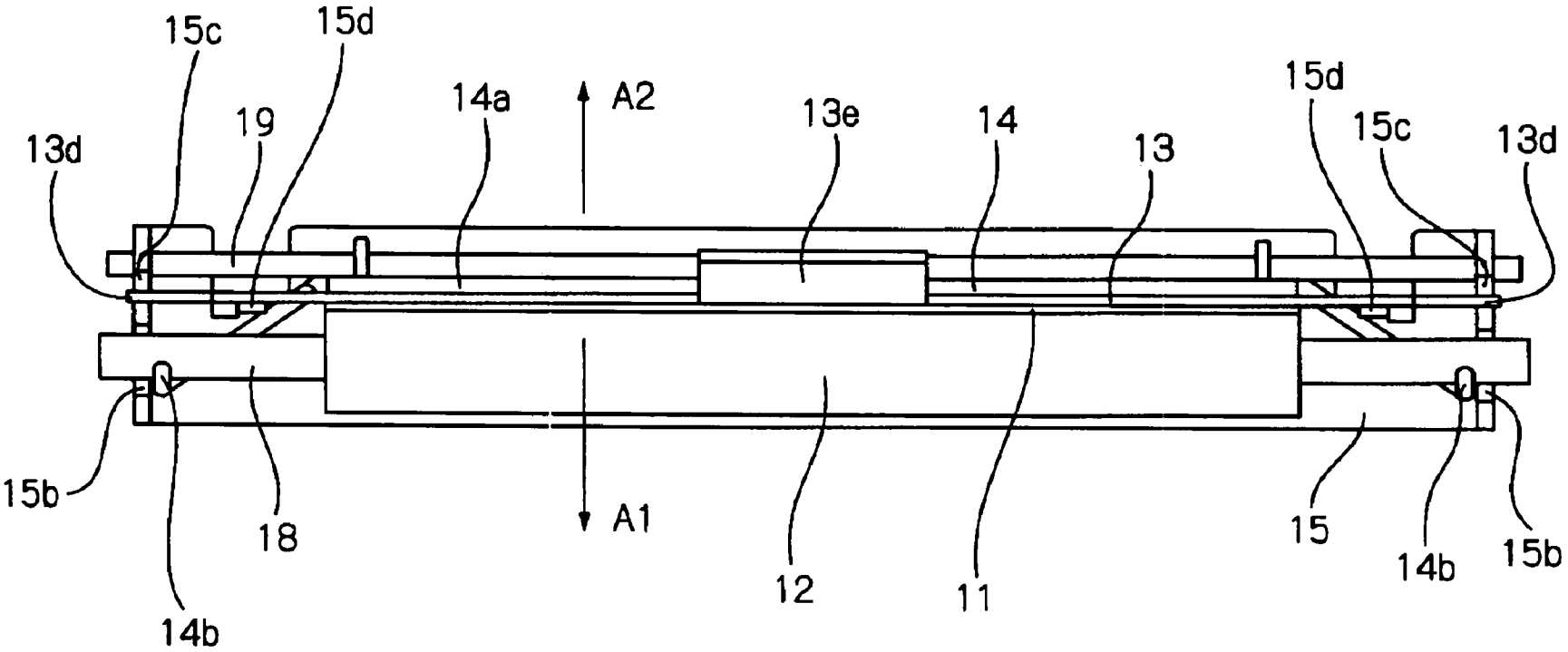
FIG. 2 is a plan view showing the main part of the thermal printer according to the first embodiment of the present invention.

As shown in FIGS. 1 and 2, a thermal printer of a first embodiment includes a thermal head 11 for heating a heat-sensitive printing layer of a sheet material 5 to perform printing thereon, a platen roller 12 for transporting the sheet material 5 being pressed by the thermal head 11, a head support member 13 for supporting the thermal head 11, a head biasing member 14 for biasing the head support member 13 to a platen roller 12 side, and a frame 15 for supporting the head support member 13.

Figure 3:
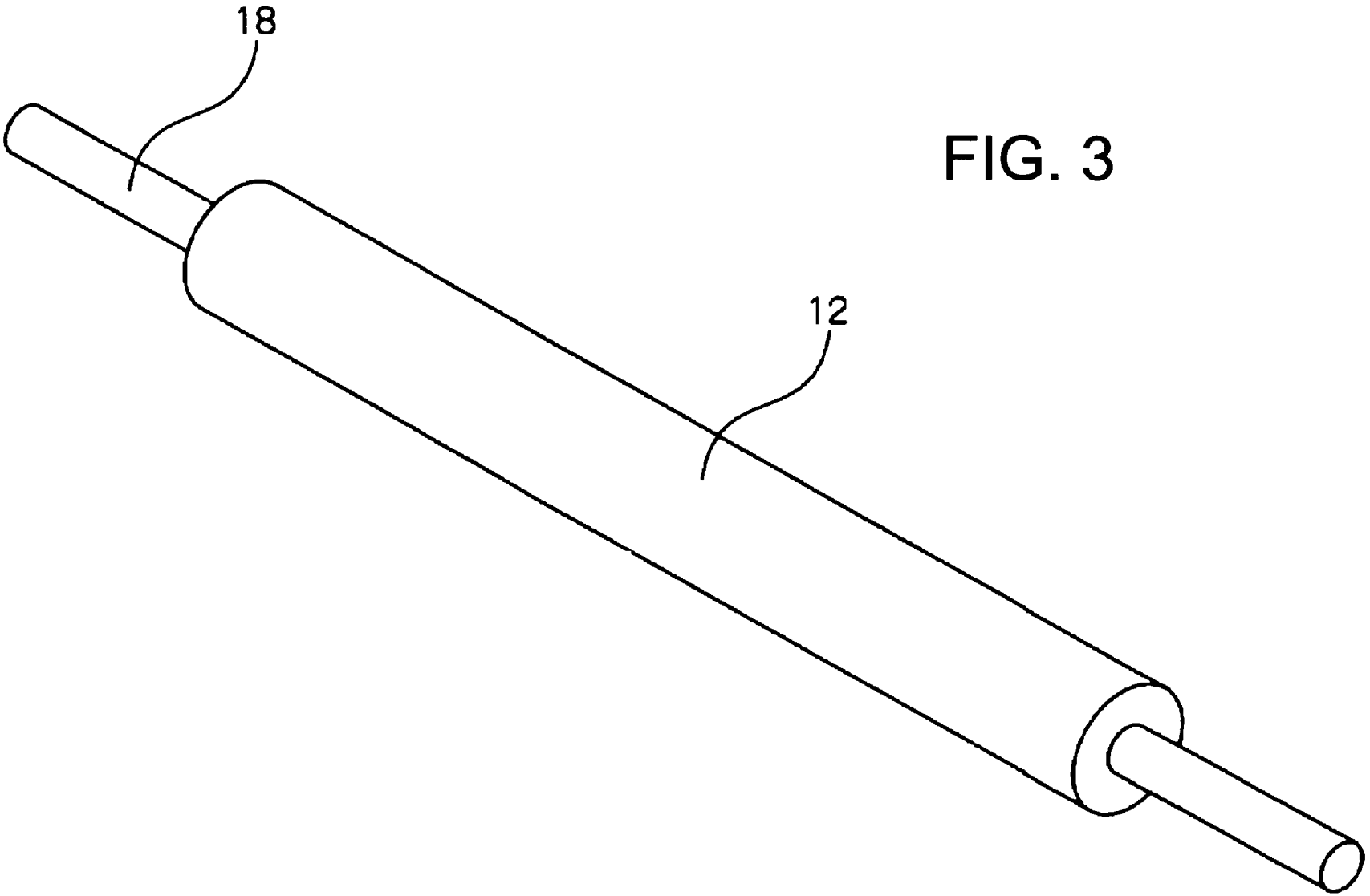
FIG. 3 is a perspective view showing a platen roller according to the first embodiment of the present invention.

The head support member 13 is provided with the thermal head 11 in an axial direction of the platen roller 12. As shown in FIG. 3, the platen roller 12 is fixed around a center portion of a rotary shaft 18 and is rotationally driven by a roller driving structure (not shown) provided at an end portion of the rotary shaft 18.

In the thermal printer, the sheet material 5 is fed from a sheet feeding device (not shown) having a sheet roll of the sheet material 5, the sheet material 5 is nipped by the thermal head 11 and the platen roller 12, and the platen roller 12 is rotationally driven to transport the sheet material 5 in a direction indicated by an arrow L shown in FIG. 1.

Figure 4:
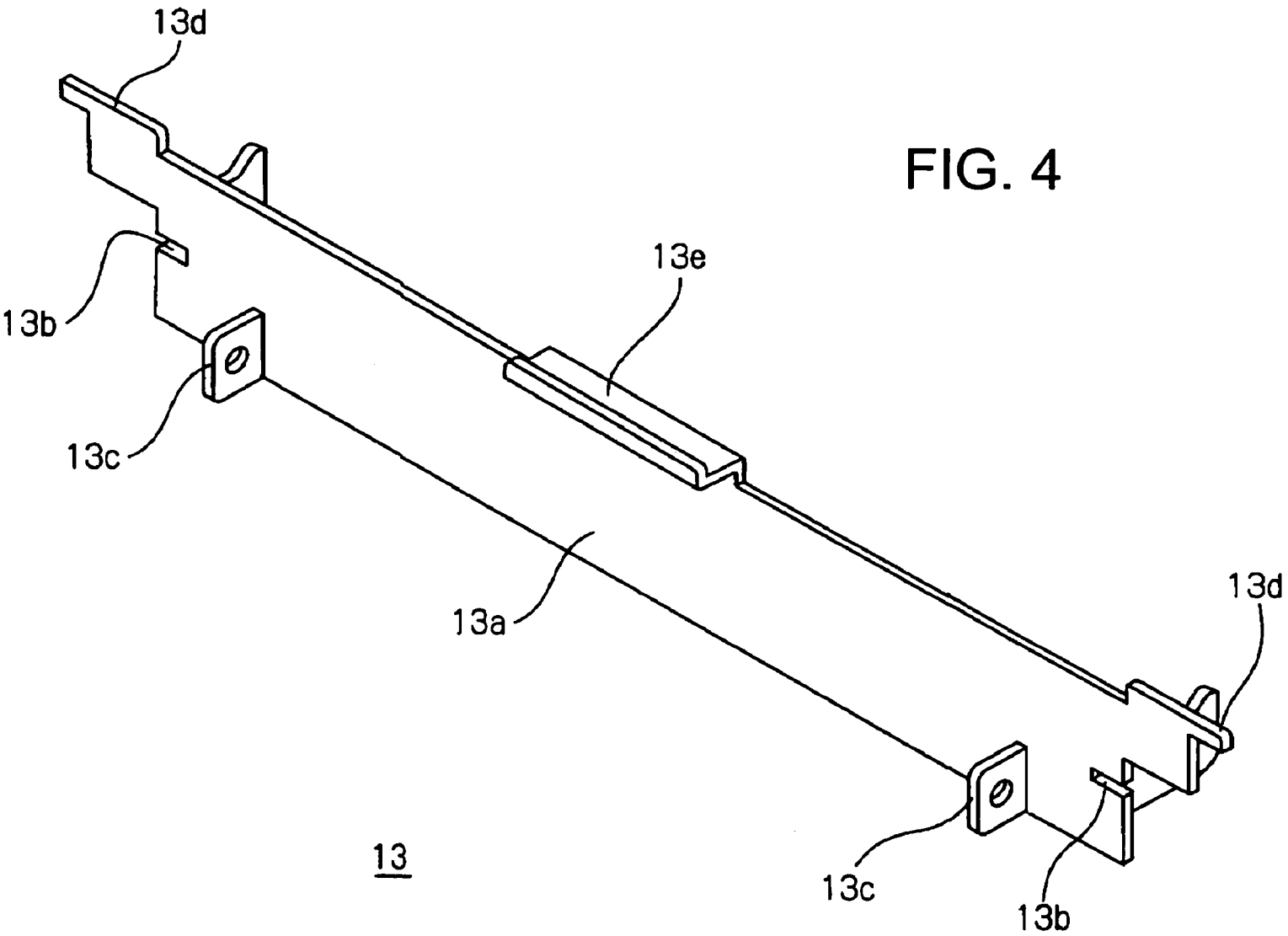
FIG. 4 is a perspective view showing a head support member according to the first embodiment of the present invention.

As shown in FIGS. 1, 2, and 4, the head support member 13 includes a support part 13*a* having a plate-like shape, for supporting the thermal head 11 at a position opposing a circumferential surface of the platen roller 12. The support part 13*a* is provided along the axial direction of the platen roller 12. The head support member 13 further includes engagement grooves 13*b*, each of which are engaged by the head biasing member 14. The head biasing member 14 is integrally fixed to the head support member 13 therethrough.

The support part 13*a* of the head support member 13 includes a pair of support pieces 13*c* which is rotatably supported by a rotation shaft 19 supported by the frame 15. As a result, the head support member 13 is rotatably supported by the frame 15 with an intermediation of the rotation shaft 19 so as to be brought into close contact with or moved away from the platen roller 12 in directions indicated by arrows A1 and A2 shown in FIG. 1.

Further, on both ends of the support part 13*a* of the head support member 13, which is in parallel with the axial direction of the platen roller 12, stopper pieces 13*d* for regulating a rotational position of the head support member 13 are integrally provided.

Further, substantially in a center portion of an upper edge of the support part 13*a* of the head support member 13, an operation piece 13*e* is integrally provided for rotationally driving the thermal head 11 in the directions indicated by the arrows A1 and A2 so as to be brought into close contact with or moved away from the platen roller 12.

Figure 5:
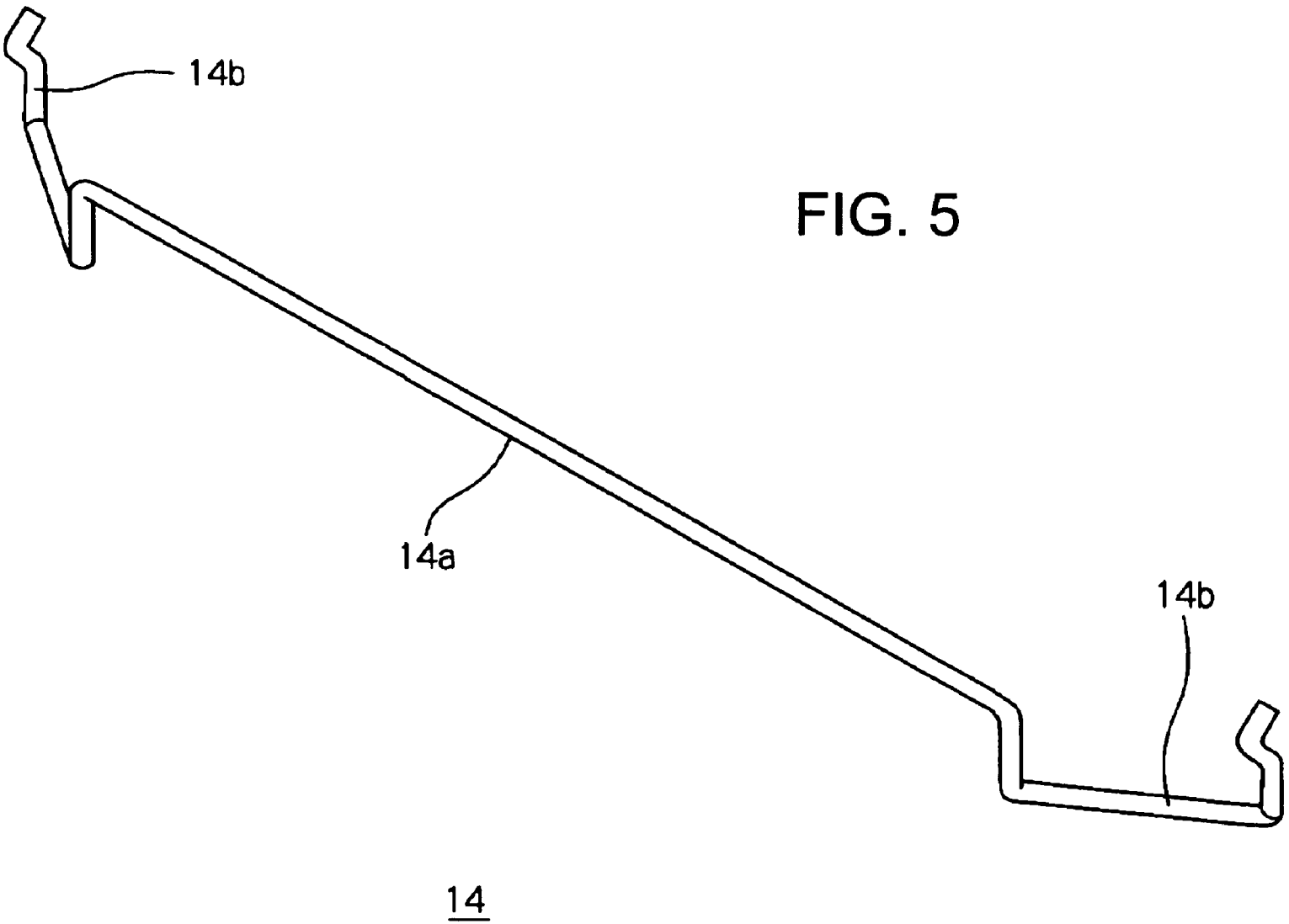
FIG. 5 is a perspective view showing a head biasing member according to the first embodiment of the present invention.

As shown in FIGS. 2 and 5, the head biasing member 14 is formed of an elastic wire such as a linear spring made of metal, and includes a pressing part 14*a* for pressing the head support member 13 and a pair of holding parts 14*b* for holding the rotary shaft 18 of the platen roller 12.

The pressing part 14*a* is provided along the support part 13*a* of the head support member 13 and is engaged to the engagement grooves 13*b*, thereby being fixed thereto. Each of the holding parts 14*b* is configured to be linearly stretched from each end of the pressing part 14*a* toward each end side of the platen roller 12 in the axial direction such that a distance between the holding parts 14*b* widens.

Figure 6:
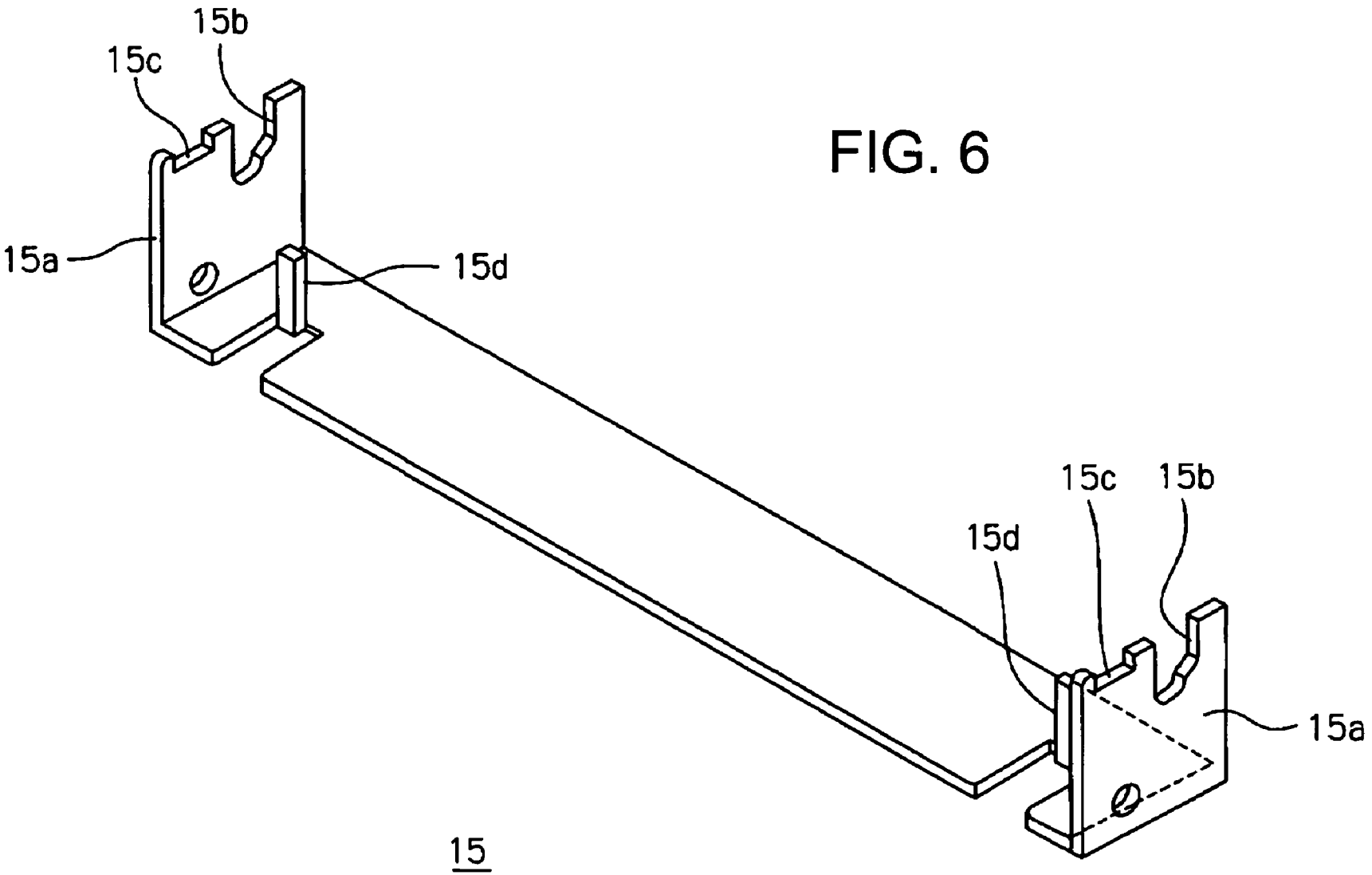
FIG. 6 is a perspective view showing a frame according to the first embodiment of the present invention.

As shown in FIG. 6, the frame 15 includes a pair of support walls 15*a* for supporting the rotation shaft 19 which rotatably supports the head support member 13. Each of the support walls 15*a* includes a notched portion serving as a support concave part 15*b* for supporting the rotary shaft 18 of the platen roller 12. Each of the support walls 15*a* further includes another notched portion serving as a position regulating concave part 15*c* to which each of the stopper pieces 13*d* of the head support member 13 is rotatably engaged in a movable manner. Further, a bottom surface of the frame 15 includes stopper pieces 15*d*, which are cut and erected, each serving as position regulating means for regulating the position of each of the holding parts 14*b* of the head biasing member 14.

Regarding the thermal printer thus constructed, an operation for establishing a state where the platen roller 12 is held by the holding parts 14*b* of the head biasing member 14 and an operation for releasing the state will be explained.

First, in a case where the platen roller 12 is to be held by each of the holding parts 14*b*, the platen roller 12 is downwardly pushed toward each of the support concave parts 15*b* of the frame 15. As a result, the rotary shaft 18 of the platen roller 12 abuts against an end portion of each of the holding parts 14*b* and each of the holding parts 14*b* is elastically deformed.

The rotary shaft 18 of the platen roller 12 elastically deforms each of the holding parts 14*b* of the head biasing member 14, to thereby move downwardly below the end portion of the each of the holding parts 14*b*. Then, as shown in FIG. 2, each of the holding parts 14*b* is engaged to the rotary shaft 18 of the platen roller 12, and the platen roller 12 is held at a position where the platen roller 12 nips the sheet material 5 with the thermal head 11.

Figure 8B:
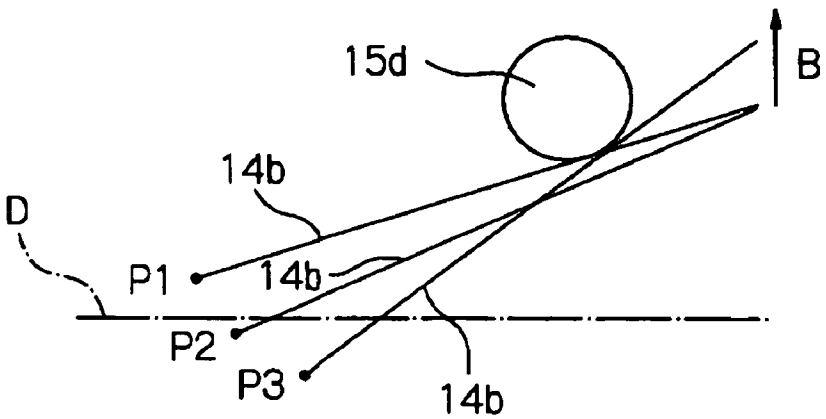
FIGS. 8A and 8B are plan views showing how the state where the platen roller is held by a holding part of the head biasing member is released.
Figure 8A:
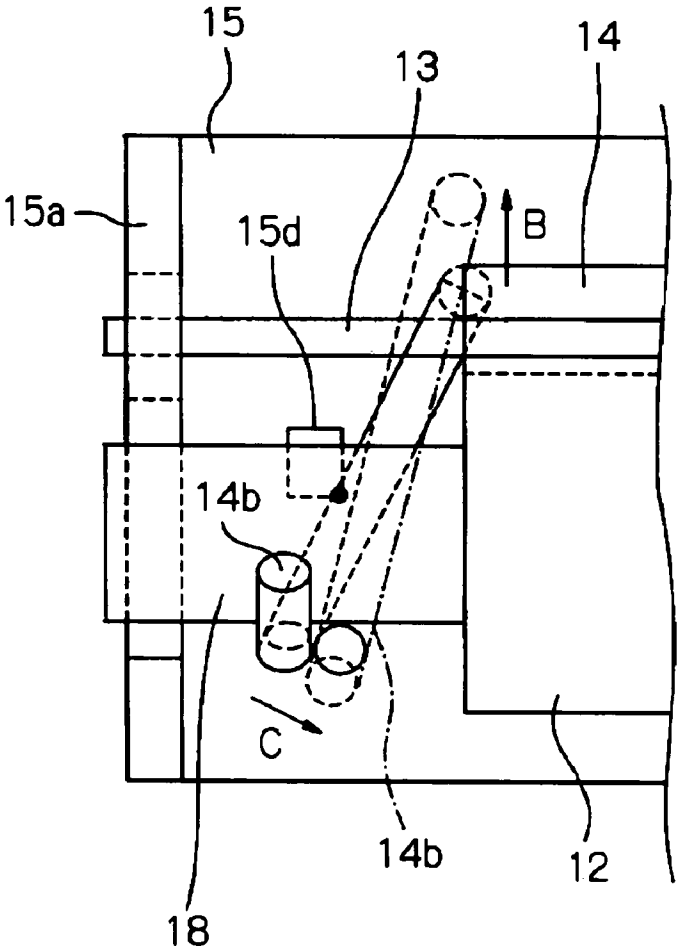

Further, in order to release the state where the platen roller 12 is held by the holding parts 14*b* of the head biasing member 14, by operating the operation piece 13*e* of the head support member 13 to move toward a direction indicated by an arrow B shown in FIG. 8A, as shown in FIG. 8A, each of the holding parts 14*b* is elastically deformed with respect to an abutting point of each of the holding parts 14*b* and each of the stopper pieces 15*d* serving as a fulcrum. Then, each of the holding parts 14*b* is moved from an engaging point of each of the holding parts 14*b* and the rotary shaft 18 of the platen roller 12 toward a direction indicated by an arrow C shown in FIG. 8A.

Figure 7:
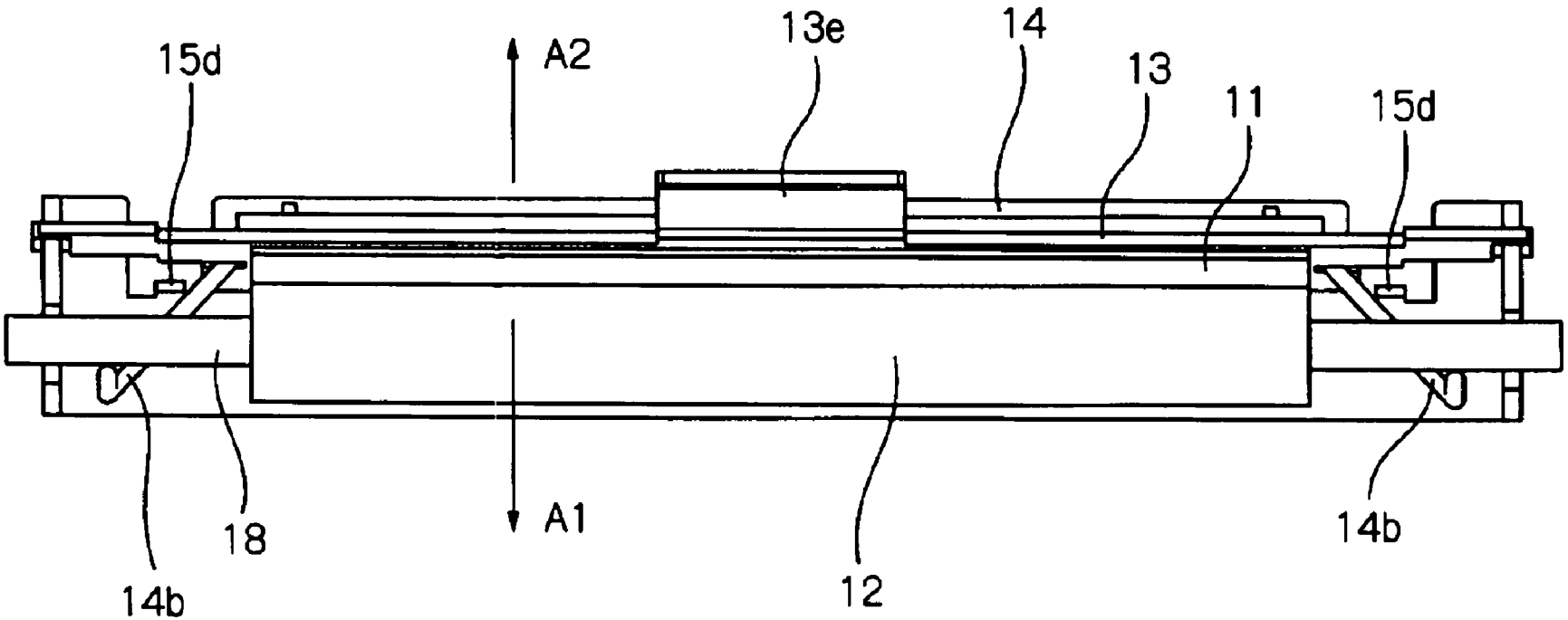
FIG. 7 is a plan view showing a released state after a held state where the platen roller is held by a holding part of the head biasing member is released.

Each of the holding parts 14*b* is moved toward the direction indicated by the arrow C, thereby releasing the state where each of the holding parts 14*b* and the rotary shaft 18 are engaged. That is, as shown in FIG. 7, the state where the platen roller 12 is held by each of the holding parts 14*b* is released.

Alternatively, instead of operating the operation piece 13*e* of the head support member 13 to move as described above, by directly operating each of the holding parts 14*b* of the head biasing member 14 to move toward the direction indicated by the arrow C so that each of the holding parts 14*b* is brought into close contact with each other, the state where the platen roller 12 is held by each of the holding parts 14*b* is released in a similar manner.

In FIG. 8B, a lowest circumferential surface level of the rotary shaft 18 of the platen roller 12 in a case where the rotary shaft 18 is engaged to each of the holding parts 14*b* is represented by a broken line D. As schematically shown in FIG. 8B, in a case where the platen roller 12 is removed, each of the holding parts 14*b* of the head biasing member 14 is moved so as to be spaced apart from each other in the axial direction of the platen roller 12, to thereby stop at a position P1 where each of the holding parts 14*b* is abutted against each of the stopper pieces 15*d*.

Further, when each of the holding parts 14*b* is engaged to the rotary shaft 18 of the platen roller 12, each of the holding parts 14*b* is moved to a position P2, thereby holding the rotary shaft 18 using elastic force acting toward the direction indicated by the arrow B. When the operation piece 13*e* of the head support member 13 is operated to be moved toward the direction indicated by the arrow B, each of the holding parts 14*b* is elastically deformed with respect to an abutting point of each of the stopper pieces 15*d* and each of the holding parts 14*b* serving as a fulcrum. Then, each of the holding parts 14*b* is moved to a position P3 and the state where each of the holding parts 14*b* is engaged to the rotary shaft 18 of the platen roller 12 is released.

Next, measurements of positional relationships among respective members of the above-mentioned thermal printer will be exemplified.

Figure 9A:
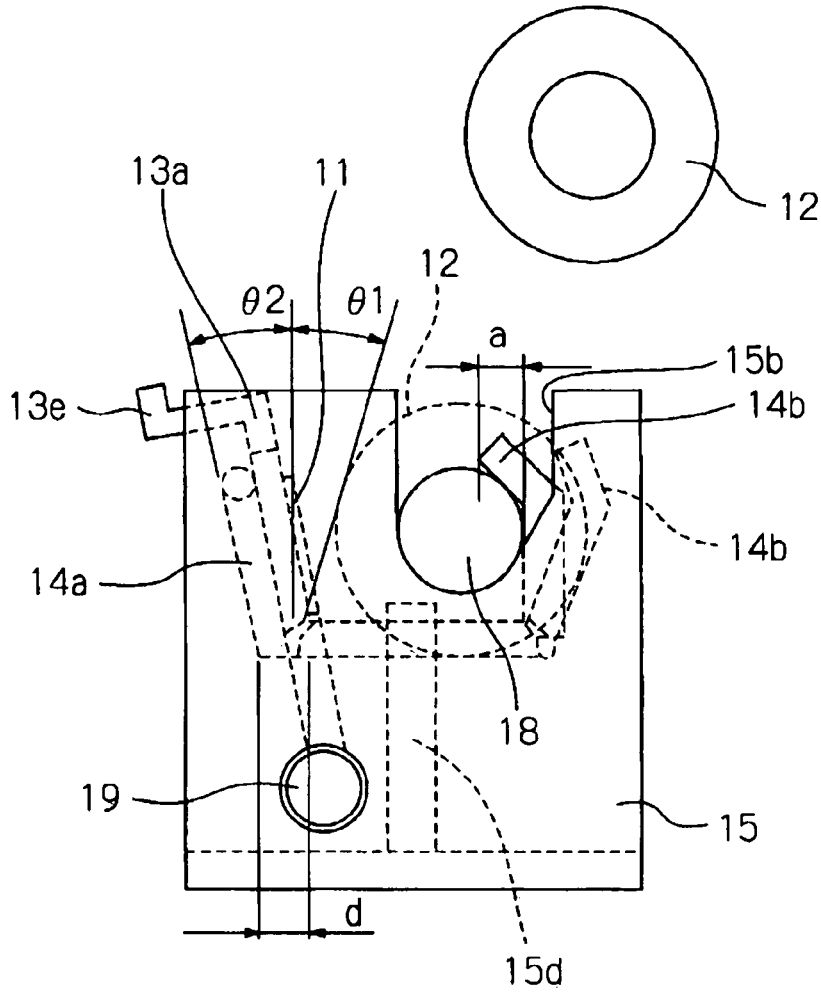
FIGS. 9A and 9B are explanatory views each showing an example of measurements of respective components.

As shown in FIG. 9A, it is assumed that an engagement amount of each of the holding parts 14*b* engaged to the rotary shaft 18 of the platen roller 12 is an engagement amount a, a rotation amount of an upper edge of the thermal head 11 with respect to the platen roller 12 is a rotation amount θ1, and a rotation amount of the support part 13*a* of the head support member 13 is a rotation amount θ2.

Figure 9B:
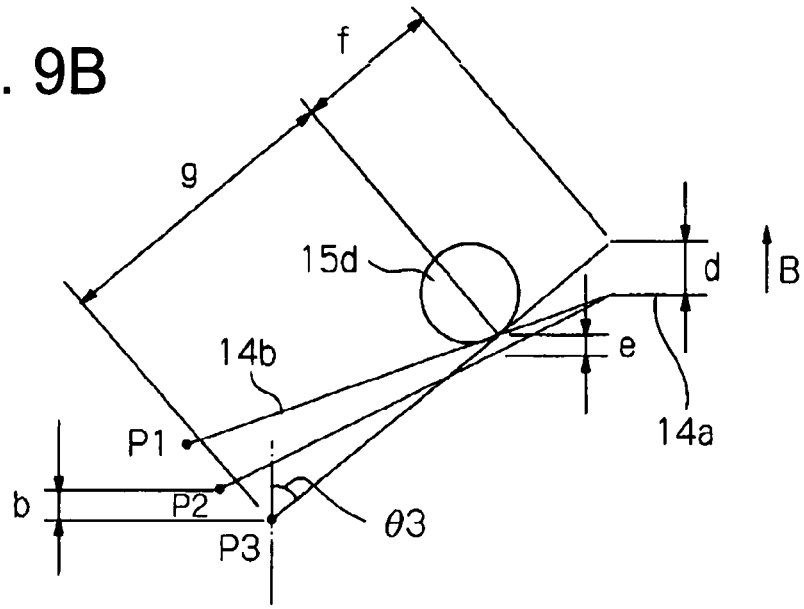

Further, as shown in FIG. 9B, it is assumed that a movement amount of each of the holding parts 14*b* between the position P2 and the position P3 in the direction indicated by the arrow B is a movement amount b, a movement amount of the support part 13*a* of the head support member 13 in the direction indicated by the arrow B is a movement amount d, a displacement amount of each of the holding parts 14*b* from the abutting point of each of the holding parts 14*b* and each of the stopper pieces 15*d* toward the direction indicated by the arrow B in a case where each of the holding parts 14*b* is moved from the position P1 to the position P2 is a displacement amount e.

Herein, in a case where the engagement amount a of each of the holding parts 14*b* is equal to or larger than "N (positive integer)", the movement amount b of each of the holding parts 14*b* is also set to be equal to or larger than "N". The rotation amount θ1 of the thermal head 11 is set based on head weight generated by the thermal head 11 pressing the platen roller 12. In a case where the movement amount d of the support part 13*a* is set to "2N", the rotation amount θ2 of the support part 13*a* is set to be approximately 15° to 20°.

Further, it is assumed that the displacement amount e of each of the holding parts 14*b* is set to be smaller than the movement amount d of the support part 13*a* (i.e., e<d), a distance between the abutting point of each of the holding parts 14*b* and each of the stopper pieces 15*d* and each end of the pressing part 14*a* in a longitudinal direction of each of the holding parts 14*b* is a distance f, and a distance between the abutting point of each of the holding parts 14*b* and each of the stopper pieces 15*d* and the end of each of the holding parts 14*b* in the longitudinal direction of each of the holding parts 14*b* is a distance g. In a case where f:g=1:2, when the movement amount b of each of the holding parts 14*b* is "N", the movement amount d of the support part 13*a* is set to "2N".

Further, each of the holding parts 14*b* at the position P3 constitute an angle θ3 with respect to the direction indicated by the arrow B, the angle θ3 being set to be equal to or smaller than 45°. By setting the angle θ3 to be equal to or smaller than 45°, the relationship between the movement amount d of the support part 13*a* of the head support member 13 and the state where each of the holding parts 14*b* is engaged to the rotary shaft 18 is preferably maintained. Further, the state where each of the holding parts 14*b* holds the rotary shaft 18 is preferably released in a smooth manner by operating the operation piece 13*e* to move.

As described above, in the thermal printer, by biasing the head support member 13 to come into press contact with the platen roller 12 and by providing the head biasing member 14 for holding the platen roller 12, the head biasing member 14 formed of an elastic wire bears two functions of the lock arm and the compressed coil springs of the above-mentioned conventional head support structure. As a result, a portion having the lock arm and the plurality of compressed coil springs in the conventional structure is eliminated, and an entire apparatus to which the head support structure is mounted can be downsized.

Therefore, in the above-mentioned thermal printer, a portion, especially a portion opposed to the head support member 13 which is opposite to the platen roller 12 side, is greatly reduced in size as compared to the conventional structure employing the compressed coil springs by providing the head biasing member 14 formed of an elastic wire. As a result, a compact structure in which the head support member 13 is pressed can be realized. Further, according to the thermal printer, the structure is simplified and the number of the components is made small, thereby reducing manufacturing costs thereof.

Second Embodiment

According to the first embodiment described above, each of the holding parts 14*b* of the head biasing member 14 is elastically deformed with respect to the abutting point of each of the stopper pieces 15*d* and each of the holding parts 14*b* serving as a fulcrum. Alternatively, each of the holding parts 14*b* may be elastically deformed with respect to a point close to the rotation shaft of the head support member serving as a fulcrum. Note that, in a second embodiment, components similar to those of the first embodiment described above are denoted by the same reference symbols and description thereof will be omitted.

Figure 10:
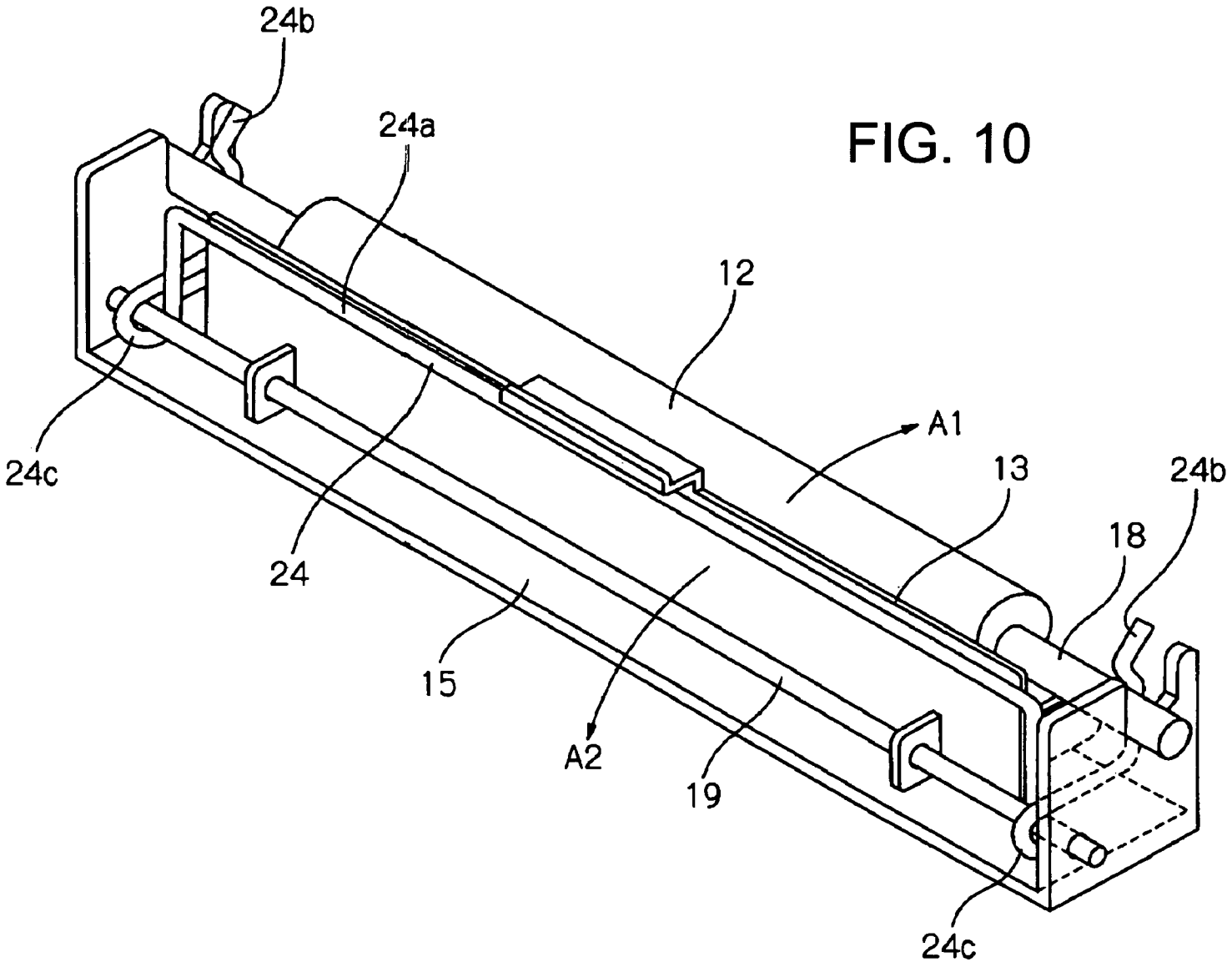
FIG. 10 is a perspective view showing a thermal printer according to a second embodiment of the present invention.
Figure 11:
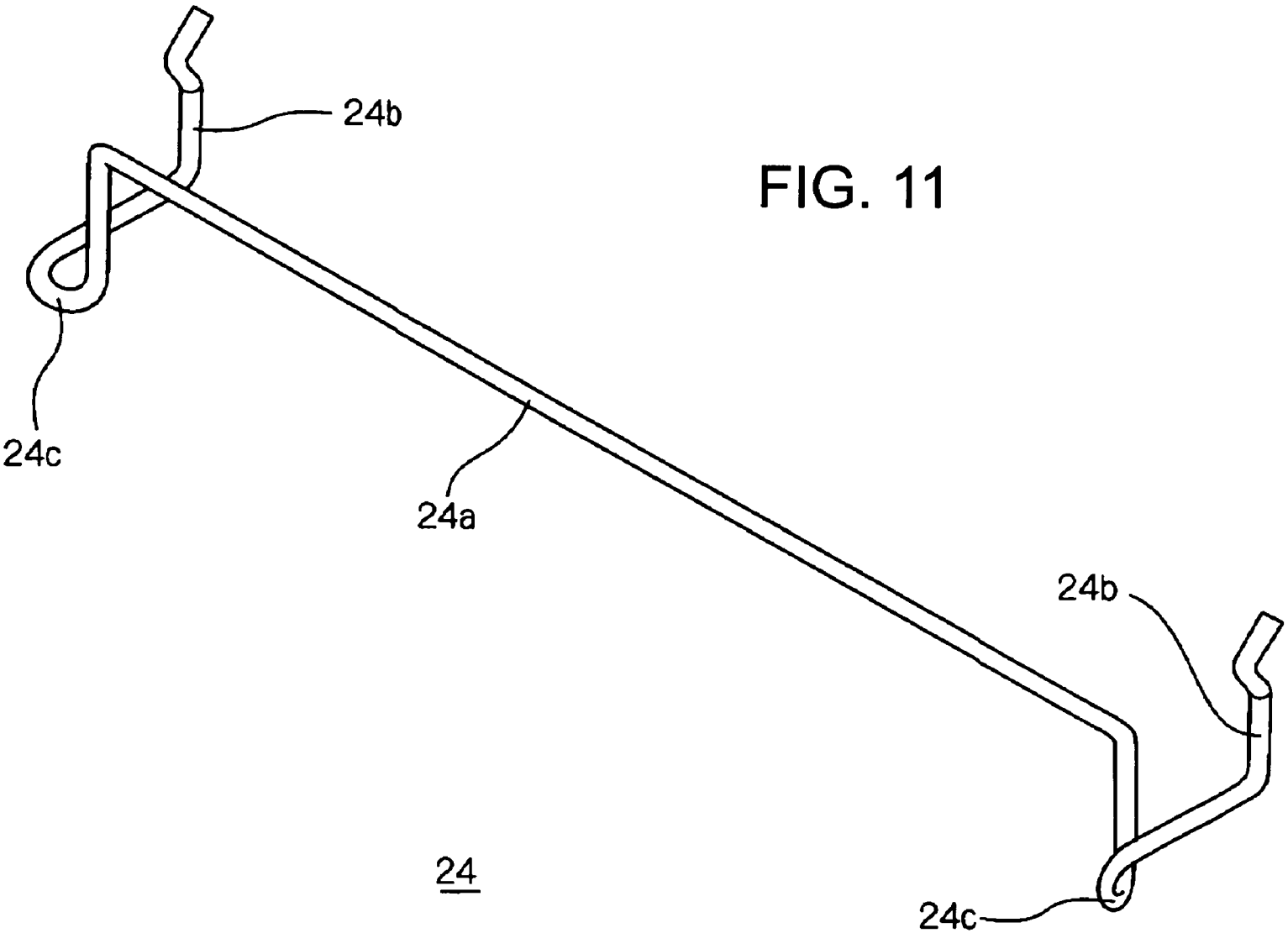
FIG. 11 is a perspective view showing a head biasing member according to the second embodiment of the present invention.

As shown in FIG. 10, a thermal printer according to the second embodiment includes a head biasing member 24 for biasing the head support member 13 to the platen roller 12 side. As shown in FIGS. 10 and 11, the head biasing member 24 is formed of an elastic wire such as a linear spring made of metal and includes a pressing part 24*a* for pressing the head support member 13, a pair of holding parts 24*b* for holding the platen roller 12, and bent parts 24*c* which are bent so as to be supported by the rotation shaft 19 which rotatably supports the head support member 13.

The pressing part 24*a* is provided along the support part 13*a* of the head support member 13. Each of the holding parts 24*b* is configured to be stretched to have a sectional view of a substantially U-shape from each end of the pressing part 24*a* to each end of the holding parts 24*b*. Each of the bent parts 24*c* is configured to be bent between the pressing part 24*a* and each of the holding parts 24*b* and to be wound around the rotation shaft 19.

In the thermal printer thus constructed, when the state where the platen roller 12 is held by the holding parts 24*b* is established or released, each of the holding parts 24*b* is elastically deformed with respect to each of the bent parts 24*c* supported by the rotation shaft 19 which rotatably supports the head support member 13 serving as a fulcrum. As a result, each of the holding parts 24*b* is moved to/from the rotary shaft 18 of the platen roller 12.

The thermal printer of this embodiment includes the head biasing member 24 in which each of the holding parts 24*b* is elastically deformed with respect to each of the bent parts 24*c* serving as a fulcrum. As a result, it becomes unnecessary for the stopper pieces 15*d* to be formed on the frame 15. Therefore, according to this embodiment, an entire apparatus to which the head support structure is mounted can be downsized as described in the first embodiment.

Third Embodiment

In the first and second embodiments described above, an elastic wire such as a linear spring is used as a head biasing member. However, a leaf spring may also be used. Note that in a third embodiment, components similar to those of the first and second embodiments described above are denoted by the same reference symbols and description thereof will be omitted.

Figure 12:
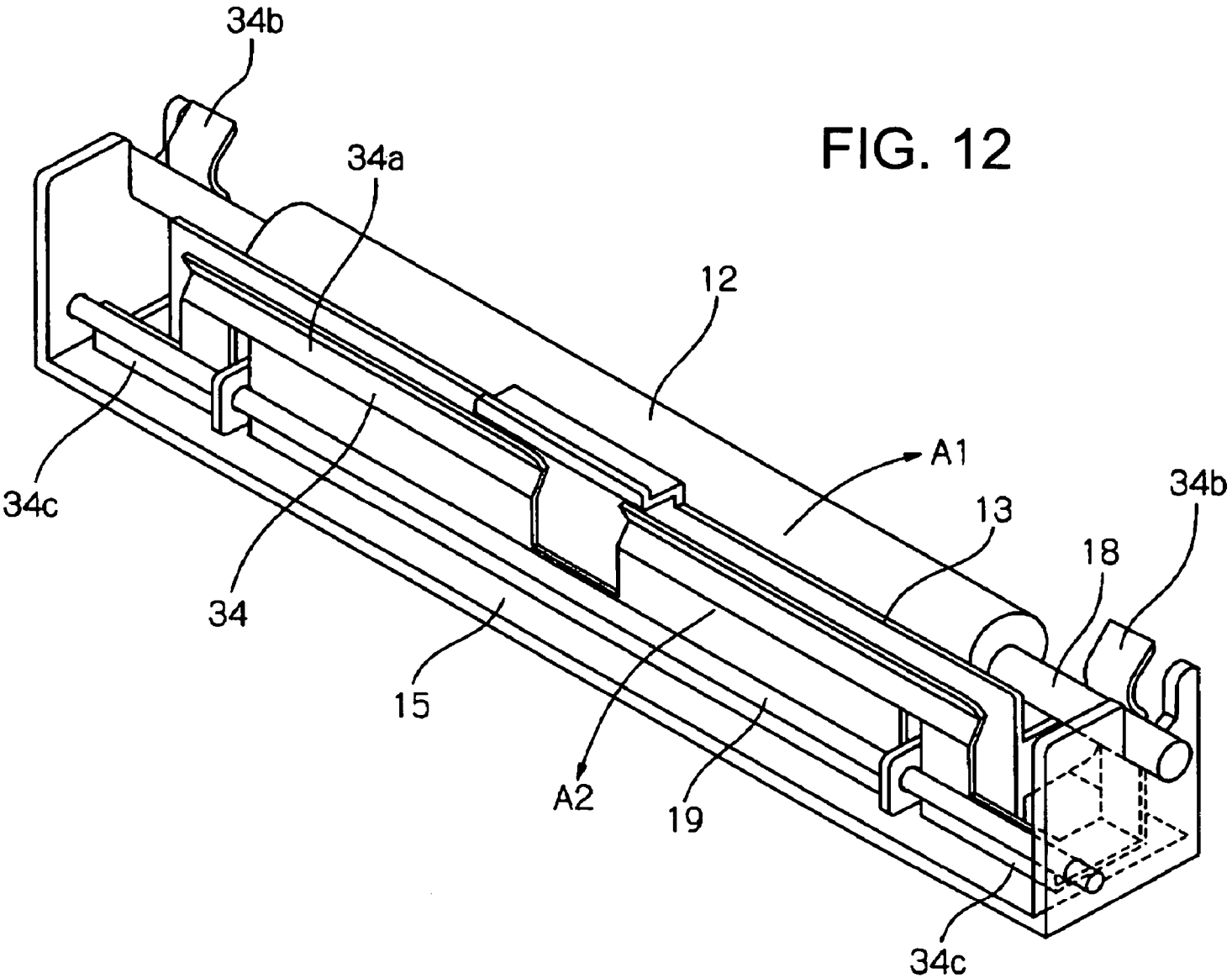
FIG. 12 is a perspective view showing a thermal printer according to a third embodiment of the present invention.
Figure 13:
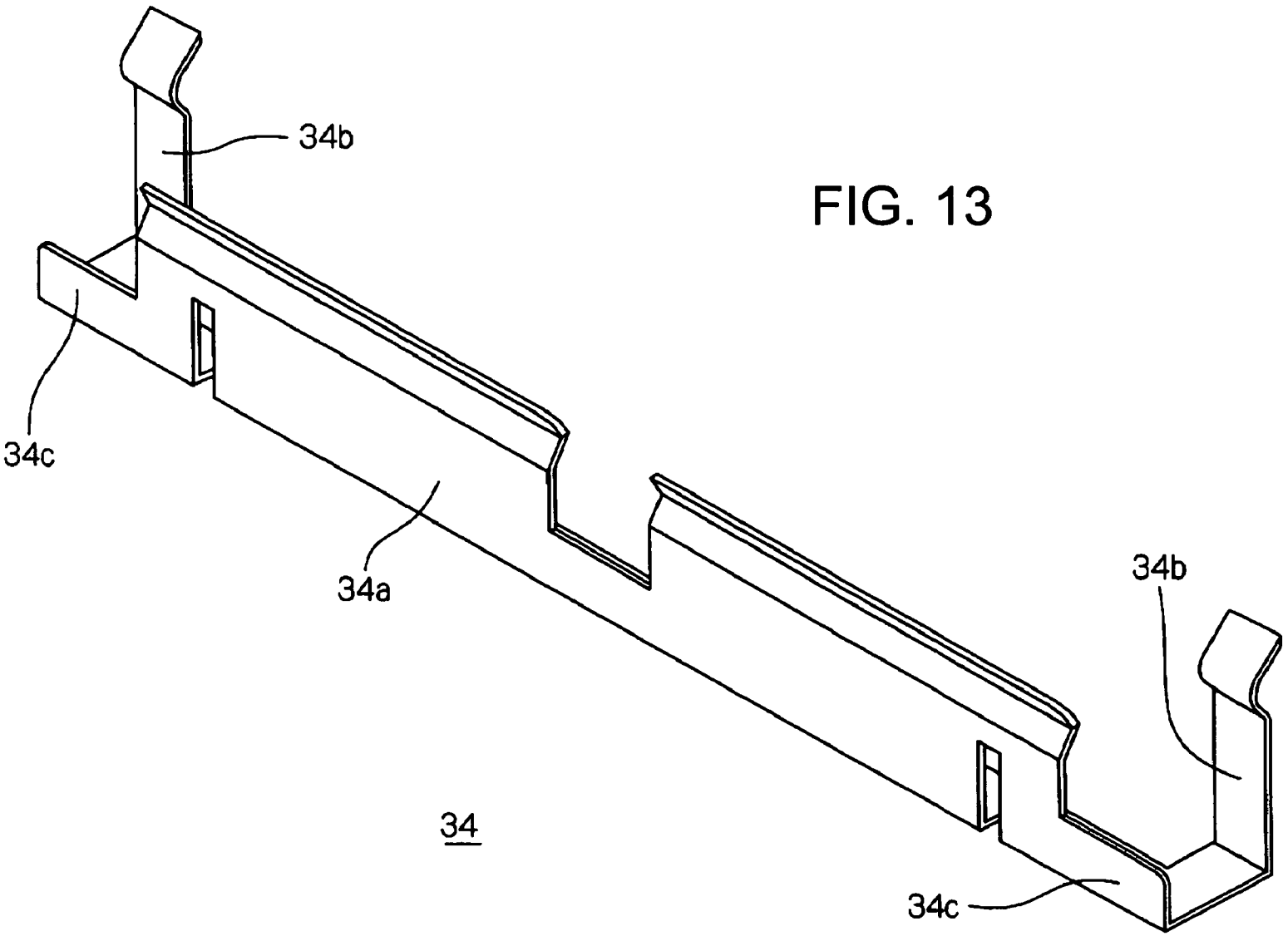
FIG. 13 is a perspective view showing a head biasing member according to the third embodiment of the present invention.

As shown in FIG. 12, a thermal printer according to the third embodiment includes a head biasing member 34 having a plate-like shape, for biasing the head support member 13 to the platen roller 12 side. As shown in FIGS. 12 and 13, the head biasing member 34 is formed of an elastic plate made of metal and includes a pressing part 34*a* having a plate-like shape, for pressing the head support member 13, a pair of holding parts 34*b* for holding the rotary shaft 18 of the platen roller 12, and bent parts 34*c* which are bent at each end of the pressing part 34*a*.

The pressing part 34*a* is provided along the support part 13*a* of the head support member 13. Each of the holding parts 34*b* is configured to be stretched to have a sectional view of a substantially U-shape from each end of the pressing part 34*a* to each end of the holding parts 34*b*. Each of the bent parts 34*c* is configured such that each of the bent parts 34*c* is bent between the pressing part 34*a* and each of the holding parts 34*b*, and that a surface of each of the bent parts 34*c* is abutted against the rotation shaft 19.

In the thermal printer thus constructed, when the state where the platen roller 12 is held by the holding parts 34*b* is established or released, each of the holding parts 34*b* is elastically deformed with respect to each of the bent parts 34*c* supported by the rotation shaft 19 which rotatably supports the head support member 13 serving as a fulcrum. As a result, each of the holding parts 34*b* is moved to/from the rotary shaft 18 of the platen roller 12.

The thermal printer of this embodiment includes the head biasing member 34 in which each of the holding parts 34*b* is elastically deformed with respect to each of the bent parts 34*c* serving as a fulcrum. As a result, it becomes unnecessary for the stopper pieces 15*d* to be formed on the frame 15 similarly to the second embodiment. Therefore, according to this embodiment, an entire apparatus to which the head support structure is mounted can be downsized as described in the first and second embodiments.

Note that the head support structure according to the present invention is applied to a thermal printer which is a printing device including a thermal head for heating a heat-sensitive printing layer of a sheet material to perform printing. However, the head support structure according to the present invention is not limited to this application. It is unnecessary to say that the head support structure according to the present invention may be applied to a thermally activating device including a thermally activating head for thermally activating a heat-sensitive adhesive layer of a sheet material, for example. In a case where the head support structure according to the present invention is applied to a printer having such the thermally activating device, an ink jet head for discharging ink may be used instead of the above-mentioned thermal head as a printing device for performing printing on a sheet material.

What is claimed is:

1. A head support structure, comprising:

a heating head for heating a sheet material;

a platen roller for transporting the sheet material being pressed by the heating head;

a head support member for supporting the heating head, which is capable of moving in one of a direction in which the head support member is brought into close contact with the platen roller and a direction in which the head support member is moved away from the platen roller; and a head biasing member for biasing the head support member to a side of the platen roller, wherein the head biasing member is formed of an elastic material and includes a pressing part for pressing the head support member against the side of the platen roller and holding parts provided at each end of the pressing part, for holding the platen roller.

2. A head support structure according to claim 1, further comprising a rotation shaft for rotatably supporting the head support member, wherein:

the head biasing member includes bent parts provided in a vicinity of the rotation shaft; and each of the holding parts is elastically deformed with respect to each of the bent parts serving as a fulcrum.

3. A head support structure according to claim 2, wherein each of the bent parts of the head biasing member is supported by the rotation shaft which rotatably supports the head support member.

4. A head support structure according to claim 1, further comprising position regulating means provided to abut against each of the holding parts of the head biasing member, for regulating a position of each of the holding parts.

5. A head support structure according to claim 2, further comprising position regulating means provided to abut against each of the holding parts of the head biasing member, for regulating a position of each of the holding parts.

6. A head support structure according to claim 1, wherein the head biasing member is formed of an elastic wire.

7. A head support structure according to claim 2, wherein the head biasing member is formed of an elastic wire.

8. A head support structure according to claim 3, wherein the head biasing member is formed of an elastic wire.

9. A head support structure according to claim 4, wherein the head biasing member is formed of an elastic wire.

10. A head support structure according to claim 5, wherein the head biasing member is formed of an elastic wire.

11. A head support structure according to claim 1, wherein the head biasing member is formed of an elastic plate.

12. A head support structure according to claim 2, wherein the head biasing member is formed of an elastic plate.

13. A head support structure according to claim 3, wherein the head biasing member is formed of an elastic plate.

14. A head support structure according to claim 4, wherein the head biasing member is formed of an elastic plate.

15. A head support structure according to claim 5, wherein the head biasing member is formed of an elastic plate.

16. A printing device, comprising the head support structure according to claim 1, wherein the heating head comprises a print head for heating a heat-sensitive printing layer of a sheet material to perform printing.

17. A thermally activating device, comprising the head support structure according to claim 1, wherein the heating head comprises a thermally activating head for thermally activating a heat-sensitive adhesive layer of a sheet material.

18. A printer, comprising:

the thermally activating device according to claim 17; and a printing device for performing printing on a sheet material.

* * * * *